US009374645B2

(12) United States Patent
Ma

(10) Patent No.: US 9,374,645 B2
(45) Date of Patent: Jun. 21, 2016

(54) FITTING DEVICE AND A METHOD OF FITTING A HEARING DEVICE TO COMPENSATE FOR THE HEARING LOSS OF A USER; AND A HEARING DEVICE AND A METHOD OF REDUCING FEEDBACK IN A HEARING DEVICE

(71) Applicant: GN ReSound A/S, Ballerup (DK)

(72) Inventor: Guilin Ma, Lyngby (DK)

(73) Assignee: GN ReSound A/S, Ballerip (DK)

( * ) Notice: Subject to any disclaimer, the term of this patent is extended or adjusted under 35 U.S.C. 154(b) by 0 days.

(21) Appl. No.: 14/142,060

(22) Filed: Dec. 27, 2013

(65) Prior Publication Data

US 2014/0112508 A1 Apr. 24, 2014

Related U.S. Application Data

(62) Division of application No. 13/025,113, filed on Feb. 10, 2011, now Pat. No. 8,744,103.

(30) Foreign Application Priority Data

May 31, 2010 (EP) ..... 10164506

(51) Int. Cl.
*H04R 25/00* (2006.01)

(52) U.S. Cl.
CPC ..... *H04R 25/45* (2013.01); *H04R 25/453* (2013.01); *H04R 25/70* (2013.01)

(58) Field of Classification Search
CPC . H04R 25/00; H04R 2225/49; H04R 2460/01
USPC ..... 381/312–313, 316–318, 320–321
See application file for complete search history.

(56) References Cited

U.S. PATENT DOCUMENTS 6,072,884 A 6/2000 Kates
6,236,731 B1 * 5/2001 Brennan et al. ..... 381/316

(Continued)

FOREIGN PATENT DOCUMENTS

CN 101438603 5/2009
EP 1439736 7/2004

(Continued)

OTHER PUBLICATIONS

J. Maxwell and P. Zurek, "Reducing acoustic feedback in hearing aids", IEEE Transactions on speech and audio processing 3 (4), pp. 304-313 (1995).
First Chinese Office Action and Search Report dated Aug. 27, 2013, for CN Patent Application No. 201110156679.X, 10 pages.

(Continued)

*Primary Examiner* — Suhan Ni
(74) *Attorney, Agent, or Firm* — Vista IP Law Group, LLP

(57) ABSTRACT

A fitting device for fitting a hearing device to compensate for a hearing loss of a user is disclosed, the hearing device comprising a receiver and a microphone, wherein a feedback path exists between the receiver and the microphone, wherein the hearing device further comprises an adaptive feedback canceller configured to reduce feedback, the adaptive feedback canceller comprising a fixed filter corresponding to an invariant portion of the feedback path, and an adaptive filter corresponding to a variant portion of the feedback path, the fitting device comprising a processor configured to determine the invariant portion of the feedback path, wherein the processor is configured to provide the fixed filter with information relating to the invariant portion of the feedback path independently of the user using the hearing device.

15 Claims, 3 Drawing Sheets

(56) References Cited

U.S. PATENT DOCUMENTS

| | | | | |
|---|---|---|---|---|
| 7,181,034 | B2 * | 2/2007 | Armstrong | 381/321 |
| 7,974,428 | B2 * | 7/2011 | Klinkby et al. | 381/318 |
| 8,280,088 | B2 * | 10/2012 | Kornagel | 381/318 |
| 8,744,103 | B2 | 6/2014 | Ma | |
| 2002/0176584 | A1 | 11/2002 | Kates | |
| 2010/0020996 | A1 * | 1/2010 | Elmedyb et al. | 381/318 |

FOREIGN PATENT DOCUMENTS

| | | |
|---|---|---|
| JP | 2007-180896 | 7/2007 |
| WO | WO 0110170 | 2/2001 |
| WO | WO 2007/113282 | 10/2007 |
| WO | WO 2010/009414 | 1/2010 |

OTHER PUBLICATIONS

Briand D. Woodruff, et al., "Fixed Filter Implementation of Feedback Cancellation for In-The-Ear Hearing Aids", Oct. 18, 1995, 2 pages.

Notice of Reasons for Rejection dated Dec. 4, 2012, for Japanese Patent Application No. 2011-120556.

Ma et al.: "Using a Reflection Model for Modeling the Dynamic Feedback Path of Digital Hearing Aids", The Journal of the Acoustical Society of America, American Institute of Physics for the Acoustical Society of America, New York, NY, US, vol. 127, No. 3, Mar. 1, 2010, pp. 1458-1468.

European Search Report mailed Jan. 21, 2011 for EP Application No. 10164506.7.

Decision on Rejection dated Dec. 2, 2014 for related Chinese Patent Application No. 201110156679.X, 13 pages.

Communication pursuant to Article 94(3) EPC dated Jun. 11, 2015, for related European Patent Application No. 10 164 506.7, 8 pages.

* cited by examiner

FITTING DEVICE AND A METHOD OF FITTING A HEARING DEVICE TO COMPENSATE FOR THE HEARING LOSS OF A USER; AND A HEARING DEVICE AND A METHOD OF REDUCING FEEDBACK IN A HEARING DEVICE

RELATED APPLICATION DATA

This application is a divisional of U.S. patent application Ser. No. 13/025,113, filed on Feb. 10, 2011, pending, which claims priority to and the benefit of European patent application No. 10164506.7, filed on May 31, 2010 . The entire disclosures of both of the above applications are expressly incorporated by reference herein.

FIELD

The present specification relates to a fitting device for fitting a hearing device to compensate for the hearing loss of a user and to a corresponding method. Additionally, the present specification relates to a method of reducing feedback in a hearing device and to a corresponding hearing device.

BACKGROUND

A hearing device comprising a receiver and a microphone may experience feedback. Feedback is a severe problem. It refers to a process in which a part of the receiver output is picked up by the microphone, amplified by the hearing device processing and sent out by the receiver again. When the hearing device amplification is larger than the attenuation of the feedback path, instability may occur and usually results in feedback whistling, which limits the maximum gain that can be achieved, and thus feedback compromises the comfort of wearing hearing devices.

J. Maxwell and P. Zurek, "reducing acoustic feedback in hearing aids", IEEE Transactions on speech and audio processing 3 (4), pp 304-323 (1995) proposed an adaptive feedback cancellation (AFC) using an adaptive Finite-Impulse-Response (FIR) filter to model the overall feedback path. This model needs a long filter to cover the major part of the feedback path impulse response and therefore has a slow converge speed and a high computational load.

To address these issues, U.S. Pat. No. 6,072,884 discloses an alternative form of the feedback path model, which represents the feedback path with two parts: a short adaptive FIR filter and a fixed filter (usually an IIR filter). The fixed filter aims at modeling the invariant or slowly-varying portion of the feedback path, whereas the adaptive filter tracks the rapidly-changing part. This model generally yields a shorter adaptive FIR filter, a faster converge speed and a smaller computational load.

However, the way to obtain the coefficients of the fixed filter in practice is to measure the feedback path for each individual user when the hearing aid is fitted to the user by a dispenser or other person trained in fitting the hearing aid to the user, and fit the fixed filter to model the measured response. This not only requires an additional fitting step, but also fails to capture the true invariant part of the feedback path because the feedback path measured by the dispenser already includes some of the variant parts. Thus, the above measured feedback path includes not only the invariant effects but also some variant effects. For example, the fitting of the hearing aid in the ear canal is included in the invariant part but it may be subject to changes when the user yawns or when the hearing aid is re-inserted to the ear.

Therefore, it is an object to provide a hearing device with improved feedback path model.

SUMMARY

According to some embodiments, the above-mentioned and other objects are fulfilled by a fitting device for fitting a hearing device to compensate for the hearing loss of a user; the hearing device comprising a receiver and a microphone, and wherein a feedback path exist between the receiver and the microphone; and wherein the hearing device further comprises an adaptive feedback canceller adapted to reduce the feedback; and wherein the adaptive feedback canceller comprises a fixed filter for modeling an invariant portion of the feedback path, and an adaptive filter for modeling a variant portion of the feedback feedback path; and wherein the fitting device is adapted to provide the fixed filter with information relating to the invariant portion of the feedback path independently of an actual user using the hearing device.

Thereby, the fitting device is able to provide parameters to the fixed filter, which parameters are describing the invariant portion of the feedback path; and thus the fixed filter does not comprise portions varying with time.

In an embodiment, the information may be provided independently of the acoustical environments where the hearing device is put into use.

In an embodiment, the provision of the information comprises calculating the invariant portion of the feedback path using information retrieved from a population.

Thereby, the fitting device is adapted to retrieve the invariant portion of the feedback path from population data obtained prior to an actual hearing device being fitted to a user; and thereby, the fitting device is adapted to provide the invariant portion of the feedback path to the fixed filter; which invariant portion does not include time-varying parts.

In an embodiment, a processor contained in the fitting device is adapted to calculate the invariant portion as a common part of a plurality of measured feedback paths, wherein the plurality of measured feedback paths are measured on a plurality of users for a type of hearing device substantially identical to the hearing device within production tolerances.

Thereby user specific effects may be kept out of the invariant portion.

Some embodiments described herein relate to a method of reducing feedback in a hearing device; the hearing device comprising a receiver and a microphone; and wherein a feedback path exist between the receiver and the microphone; wherein the hearing device further comprises an adaptive feedback canceller adapted to reduce the feedback, and wherein the adaptive feedback canceller comprises a fixed filter for modeling an invariant portion of the feedback path, and an adaptive filter for modeling a variant portion of the feedback path; and wherein the method comprises modeling the feedback using the invariant portion and the variant portion using the fixed filter and the adaptive filter; and the invariant portion is provided to the fixed filter of the hearing device independently of an actual user using the hearing device.

Thereby, the method is able to provide parameters to the fixed filter, which parameters are describing the invariant portion of the feedback path; and thus the fixed filter does not comprise portions varying with time.

In an embodiment, the information may be provided independently of the acoustical environments where the hearing device is put into use.

In an embodiment, the providing comprises calculating the invariant portions based on information retrieved from a population.

Thereby, the method is adapted to retrieve the invariant portion of the feedback path from population data obtained prior to an actual hearing device being fitted to a user; and thereby, the fitting device is adapted to provide the invariant portion of the feedback path to the fixed filter; which invariant portion does not include time-varying parts.

In an embodiment, the providing comprises calculating the invariant portion as a common part of a plurality of measured feedback paths, wherein the plurality of measured feedback paths are measured on a plurality of users for a type of hearing device substantially identical to the hearing device within production tolerances.

Thereby user specific effects may be kept out of the invariant portion.

In an embodiment, the providing comprises calculating the invariant portion using a common-acoustical-pole-zero model.

Thereby, the method is able to estimate the common poles successfully at least in a noise-free or substantially noise-free environment.

In an embodiment, the providing comprises calculating the invariant portion using an iterative least square search.

Thereby, the method is able to estimate the invariant portion successfully in a noisy environment.

In an embodiment, calculating the invariant portion comprises providing the common-acoustical-pole-zero model as an initial estimate for the iterative least square search.

Thereby, the method is able to obtain a more precise estimate on the invariant portion of the feedback path because the combination of the CPZ and ILSS methods does not suffer from having problems in noisy environments as the CPZ method and without having problems with local minima as the ILSS method.

In an embodiment, the method further comprises providing the adaptive filter with two cascaded adaptive filters with different adaptation speeds.

Thereby, the method is able to provide a filter for the invariant portion of the feedback path (the fixed filter), and a filter for the slowly varying portion of the feedback path (a first adaptation speed cascaded adaptive filter), and a filter for the fast varying portion of the feedback path (a second adaptation speed cascaded adaptive filter). Thereby a more precise estimation of the feedback path is obtained.

In an embodiment, the method further comprises using the adaptive filters in parallel, and controlling which of the adaptive filters is active via a switch contained in the hearing device.

In some embodiments, a hearing device includes a receiver and a microphone; wherein a feedback path from the receiver to the microphone exists; wherein the hearing device further comprises an adaptive feedback canceller adapted to reduce the feedback; and wherein the adaptive feedback canceller comprises a fixed filter for modeling an invariant portion of the feedback path, and an adaptive filter for modeling a variant portion of the feedback path; and wherein the invariant portion is provided to the fixed filter of the hearing device independently of an actual user using the hearing device.

The hearing device and embodiments thereof has the same advantages as the method of reducing feedback for the same reasons.

In an embodiment, the information may be provided independently of the acoustical environments where the hearing device is put into use.

In an embodiment, the invariant portion comprises information retrieved from a population.

In an embodiment, the invariant portion comprises a common part of a plurality of measured feedback paths, wherein the plurality of measured feedback paths are measured on a plurality of users for a type of hearing device substantially identical to the hearing device within production tolerances.

In an embodiment, the invariant portion comprises information calculated using a common-acoustical-pole-zero model.

In an embodiment, the invariant portion comprises information calculated using an iterative least square search.

In an embodiment, the invariant portion comprises information calculated by providing the common-acoustical-pole-zero model as an initial estimate for the iterative least square search.

In an embodiment, the adaptive filter comprises two cascaded adaptive filters with different adaptation speeds.

In an embodiment, the adaptation speed of a first of the cascaded adaptive filters is selected, for example in the order of ms e.g. from the range of 1 ms to 10 ms; and the adaptation speed of a second of the cascaded adaptive filters is selected, for example, in the order of seconds, e.g. from the range of 10 ms to 1 second.

In an embodiment, the adaptive filters are used in parallel, and wherein the hearing device further comprises a switch controlling which of the adaptive filters is active.

Some embodiments described herein relate to a method of fitting a hearing device to compensate for the hearing loss of a user; the hearing device comprising a receiver and a microphone, and wherein a feedback path exist between the receiver and the microphone; and wherein the hearing device further comprises an adaptive feedback canceller adapted to reduce the feedback; and wherein the adaptive feedback canceller comprises a fixed filter for modeling an invariant portion of the feedback path, and an adaptive filter for modeling a variant portion of the feedback path; and wherein the fitting comprises providing the invariant portion to the fixed filter of the hearing device independently of an actual user using the hearing device.

The method of fitting and embodiments thereof comprises the same advantages as the fitting device for the same reasons.

In an embodiment, the invariant portion is additionally provided independently of the acoustical environments where the hearing aid is put into use.

In an embodiment, the fitting comprises calculating the invariant portion using information retrieved from a population.

In an embodiment, the fitting comprises calculating the invariant portion as a common part of a plurality of measured feedback paths, wherein the plurality of measured feedback paths are measured on a plurality of users for a type of hearing device substantially identical to the hearing device within production tolerances.

In an embodiment, the method of fitting further comprises performing an online calibration of the hearing device on a user once the invariant portion of the feedback path has been provided to the hearing device.

Thereby is achieved that the online calibration can be performed for each individual user while the device is in use so that user characteristics can be captured also, once the invariant portion has been identified and provided to the hearing device.

In accordance with some embodiments, a fitting device for fitting a hearing device to compensate for a hearing loss of a user is disclosed, the hearing device comprising a receiver and a microphone, wherein a feedback path exists between the receiver and the microphone, wherein the hearing device further comprises an adaptive feedback canceller configured to reduce feedback, the adaptive feedback canceller comprising a fixed filter corresponding to an invariant portion of the feedback path, and an adaptive filter corresponding to a variant portion of the feedback path, the fitting device comprising a processor configured to determine the invariant portion of the feedback path, wherein the processor is configured to provide the fixed filter with information relating to the invariant portion of the feedback path independently of the user using the hearing device.

In accordance with other embodiments, a method of reducing feedback in a hearing device is disclosed, the hearing device comprising a receiver and a microphone, wherein a feedback path exists between the receiver and the microphone, wherein the hearing device further comprises an adaptive feedback canceller configured to reduce the feedback, the adaptive feedback canceller comprising a fixed filter corresponding to an invariant portion of the feedback path, and an adaptive filter corresponding to a variant portion of the feedback path, the method comprising providing the invariant portion of the feedback path to the fixed filter of the hearing device, and modeling the feedback using the invariant portion and the variant portion using the fixed filter and the adaptive filter, wherein the invariant portion of the feedback path is provided to the fixed filter of the hearing device independently of an actual user using the hearing device.

In accordance with other embodiments, a hearing device includes a receiver, a microphone, wherein a feedback path exists between the receiver to the microphone, and an adaptive feedback canceller configured to reduce the feedback, wherein the adaptive feedback canceller comprises a fixed filter corresponding to an invariant portion of the feedback path, and an adaptive filter corresponding to a variant portion of the feedback path, and wherein the fixed filter is configured to obtain the invariant portion independently of an actual user using the hearing device.

In accordance with other embodiments, a fitting method includes fitting a hearing device to compensate for a hearing loss of a user, the hearing device comprising a receiver and a microphone, wherein a feedback path exists between the receiver and the microphone, and wherein the hearing device further comprises an adaptive feedback canceller configured to reduce the feedback, the adaptive feedback canceller comprising a fixed filter corresponding to an invariant portion of the feedback path, and an adaptive filter corresponding to a variant portion of the feedback path, wherein the fitting comprises providing the invariant portion to the fixed filter of the hearing device independently of the user using the hearing device.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings.

These drawings depict only typical embodiments and are not therefore to be considered limiting of its scope.

DETAILED DESCRIPTION

Figure 1:
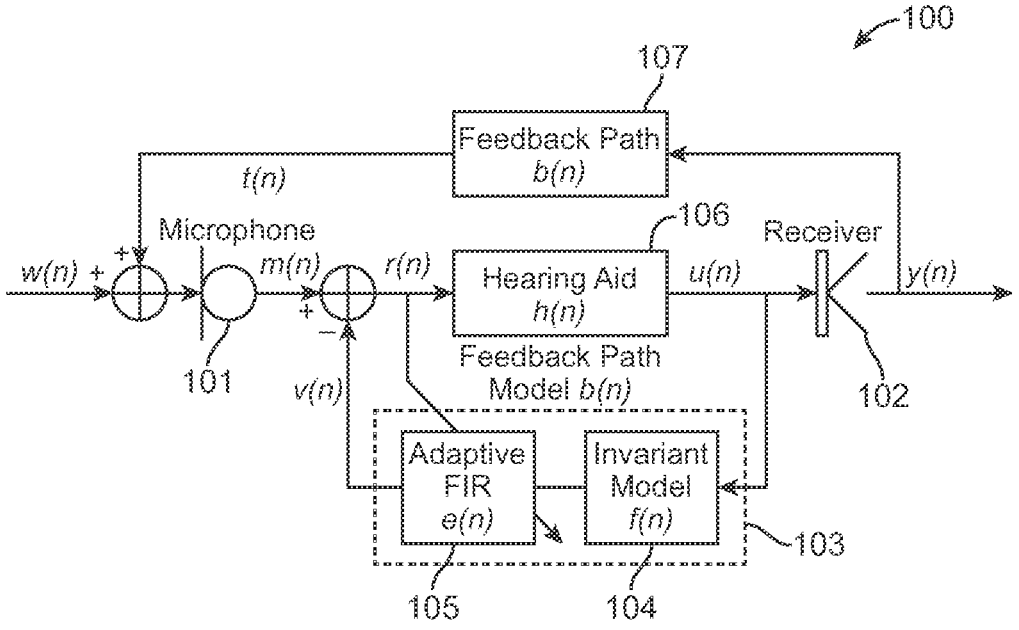
FIG. 1 shows an embodiment of a hearing aid comprising an adaptive feedback canceller.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated or described.

In the above and below, a hearing device may be selected from the group consisting of a hearing aid, a hearing prosthesis, and the like. Examples of a hearing device may include a behind the ear (BTE) hearing aid and a in the ear (ITE) hearing aid and a completely in the canal (CIC) hearing aid.

FIG. 1 shows an embodiment of a hearing device 100 comprising a microphone 101 and a receiver 102.

In an embodiment, a feedback path 107 comprising an impulse response b(n) exists between the receiver 102 and the microphone 101. The feedback path 107 may be an acoustical and/or an electrical and/or a mechanical feedback path. In the above and below, n denotes a discrete-time index and n starts from 0.

The hearing device 100 may further comprise a processor 106 or the like adapted to process the signal from the microphone 101 according to one or more algorithms.

In an embodiment, the hearing device may comprise a fixed filter 104 containing an invariant portion of a feedback path model.

In an embodiment, the hearing device may comprise an adaptive feedback canceller 103. The adaptive feedback canceller 103 may comprise a fixed filter 104 containing an invariant portion of a feedback path model, and an adaptive filter 105 containing a variant portion of feedback path model.

Thereby, the adaptive feedback canceller 103 may divide an impulse response of a feedback path model $\hat{b}(n)$ into two parts: the invariant feedback path model comprising an impulse response f(n) and the variant feedback path model comprising the impulse response e(n). Thus, the adaptive feedback canceller may track variations of the feedback path b(n) using the invariant $\hat{b}(n)$ and the variant e(n) feedback path models.

In an embodiment, the invariant feedback path model may be contained in a finite-impulse-response (FIR) filter or in an infinite-impulse-response (IIR) filter.

In a first embodiment, extraction of the invariant part of the feedback path can be done by measuring it directly. However, since in practice the invariant part is coupled with the variant part in the feedback path very closely, it may be very difficult to isolate the invariant part unless each component is detached from the hearing device and measured individually, which requires high precision in the measurements. Furthermore, the measured invariant part is only valid for a single device due to the variation within the batch of components.

In a second embodiment, each component is modeled either theoretically by using an equivalent electro-acoustical model or numerically by using methods such as boundary element calculations. To yield a good estimate of the invariant part, these methods need to build a precise model for every component, which may be difficult for some of the components.

In a third embodiment, the invariant feedback path model 104 is extracted from a set of measured feedback paths. The idea is to measure a number of feedback paths using the same type of hearing devices on different users and/or under different acoustical environments. The invariant part of the feedback path can then be regarded as the common part of these measured feedback paths.

In the third embodiment, N feedback paths comprising the impulse responses $b_1(n)$; $b_2(n)$; . . . ; $b_N(n)$ may have been measured. In principle, the feedback path impulse responses may have infinite duration. Therefore, it may be assumed in the following that the impulse responses of the feedback paths and the feedback path models are all truncated to a sufficient length L. For example, the feedback paths and the feedback path models may be truncated such that the energy loss in the impulse response due to the truncation is at least 35 dB below the total energy of the responses. The N feedback paths may constitute a population.

Let f(n) and $e_k(n)$ denote the impulse response of the invariant model and the variant model of the k-th feedback path respectively. The k-th modeled feedback path $\hat{b}_k(n)$ is then the convolution of $e_k(n)$ and f(n), i.e.

$$\hat{b}_k(n)=e_k(n)\odot f(n); \tag{1}$$

where $\odot$ is the convolution operator, and the symbol ^ is used to denote the estimate of the corresponding quantity in the above and below.

One way to extract the invariant part is to formulate a problem of extracting the invariant feedback path model. The extraction problem may be formulated by estimating f(n) with the objective of minimizing the difference between the modeled feedback path $\hat{b}_k(n)$ and the measured feedback path $b_k(n)$. Due to the different vent sizes, pinna shapes and microphone locations for different users, some of the measured feedback impulse responses may contain more energy than others. This may result in a preference of minimizing the modeling error for large feedback paths. If the measurement is conducted in the same way for all the measured feedback paths, every measured feedback path should be treated equally.

Therefore, the measured impulse responses $b_k(n)$ is first scaled to $\tilde{b}_k(n)$ so that $\Sigma_{i=0}^{L-1}|\tilde{b}_k(i)|^2$ is a constant for any k.

The extraction problem of the invariant path model can then be formulated as follows:

$$\hat{f}(n)=\arg\min_{f(n)}\|\tilde{B}-\hat{B}\|_2^2; \tag{2}$$

$$\tilde{B}=[\tilde{b}_1^T,\ldots,\tilde{b}_N^T]^T; \tag{3}$$

$$\hat{B}=[\hat{b}_1^T,\ldots,\hat{b}_N^T]^T; \tag{4}$$

$$\tilde{b}_k=[\tilde{b}_k(0),\ldots,\tilde{b}_k(L-1)]^T; \tag{5}$$

$$\hat{b}_k=[\hat{b}_k(0),\ldots,\hat{b}_k(L-1)]^T; \tag{6}$$

where $\|\ \|_2$ denotes the Euclidean norm, the superscript T denotes the transpose of a matrix or a vector, and $\hat{b}_k(n)$ is defined in equation (1). The bold symbol represents a matrix or a vector.

Equation (2)-(6) represents an optimization problem which is non-linear. Below, solution methods based on a common-acoustical-pole and zero modeling (CPZ) model and an iterative least-square search (ILSS) method and a combination of the two are described.

In an alternative embodiment, the extraction problem is formulated in the frequency domain and a weighting for the importance of each frequency bin can be applied on the optimization problem. This will require a corresponding change in the below mentioned solution methods (CPZ, ILLS and a combination of the two).

In an embodiment, the optimization problem described above is solved using a common-acoustical-pole and zero modeling (CPZ). For feedback path modeling, the invariant part includes the responses of the receiver, the tube inside the hearing device shell, the hook, the microphone, etc., most of which also exhibit resonances. Therefore, it should also contain common poles although common zeros may also exist.

Since the resonances usually need long FIR filters to model, the CPZ model should capture the majority of the invariant part of the feedback path if the number of common zeros is not very large. In this case, the small number of common zeros can be moved to the short FIR filter in the variant model $e_k(n)$.

To estimate the common poles, a number of measured impulse responses should be used instead of one single impulse response because poles are strongly affected or canceled by zeros in a single impulse response.

When the invariant part of the feedback path is modeled by an all-pole filter with P poles and the variant part of the feedback path is modeled by an FIR filter with Q zeros (which may include common zeros), the complete feedback path model becomes an Autoregressive Moving Average (ARMA) model:

$$\hat{b}_k(n)=-\Sigma_{i=1}^{P}a_i\hat{b}_k(n-i)+\Sigma_{i=0}^{Q}c_{i,k}\delta(n-i); \tag{7}$$

where δ is the unit pulse function (δ(n)=1 for n=0, and δ(n)=0 for any other n), $a_i$'s are the coefficients of the common Autoregressive (AR) model and $c_{i,k}$'s are the coefficients of the Moving Average (MA) model for the k-th feedback path model. The impulse responses f(n) and $e_k(n)$ then correspond to the impulse response of the common AR model and the MA model of the k-th feedback path model respectively.

The estimation of f(n) in equation (2) becomes an estimation of $a_i$'s $$\{\hat{a}_i\}_{i=1}^{P}=\arg\min_{a_1,\ldots,a_P}\|\tilde{B}-\hat{B}\|_2^2. \tag{8}$$

which is known to be a difficult problem. However, it can be reformulated as a new problem, by replacing the error between the modeled feedback path and the measured feedback path with a so-called "equation error". An optimal analytic solution to this problem exists although it can be suboptimal to the original problem in equation (8), $$x=(A^TA)^{-1}A^T\overline{B}; \tag{9}$$

$$x=[\hat{a}^T,\hat{c}_1^T,\ldots,\hat{c}_N^T]^T; \tag{10}$$

$$\hat{a}=[-\hat{a}_1,\ldots,-\hat{a}_P]^T; \tag{11}$$

$$\hat{c}_k=[-\hat{c}_{0,k},\ldots,-\hat{c}_{Q,k}]^T; \tag{12}$$

$$\overline{B}=[\overline{b_1^T},\ldots,\overline{b_N^T}]^T; \tag{13}$$

$$\overline{b}_k=[\tilde{b}_k(0),\ldots,\tilde{b}_k(L-1),0_{1\times P}]^T; \tag{14}$$

where $\hat{a}_i$'s and $\hat{c}_{k,i}$'s are the estimate of $a_i$'s and $c_{k,i}$'s respectively, $0_{1\times P}$ is a row vector containing P zeros and the matrix A is defined in Appendix A.

In an embodiment, the optimization problem described above is solved using an Iterative least-square search (ILSS) method.

As disclosed above, the invariant model of a feedback path may contain not only poles but also zeros. Therefore, the ILSS approach, which does not make assumptions on the pole-zero structure but estimates the impulse response directly, may be more general than the CPZ method.

Suppose that the length of the impulse response of the invariant model f(n) and the variant model $e_k(n)$ is truncated to C and M respectively, and that $M+C-1 \leq L$.

The feedback path model $\hat{b}_k(n)$ of the length L is then the convolution between $e_k(n)$ and f(n) with zero-padding:

$$\hat{b}_k = [e_k^T F, 0_{1\times(L+1-M-C)}]^T \tag{15}$$

$$= [f^T E_k, 0_{1\times(L+1-M-C)}]^T; \tag{16}$$

$$f = [f(C-1), f(C-2), \ldots, f(0)]^T; \tag{17}$$

$$e_k = [e_k(M-1), e_k(M-2), \ldots, e_k(0)]^T; \tag{18}$$

Where $0_{1\times(L+1-M-C)}$ is a row vector with (L+1−M−C) zeros, the convolution matrices $E_k$ and F are formed by $e_k(n)$ and f(n) respectively and defined in Appendix B.

To obtain the estimate of f(n), an iterative search is performed in four steps:

Step 1: Set iteration counter i=0, and set $\hat{f}$ to an initial value $\hat{f}^0$, where the superscript denotes the iteration number and the symbol ˆ denotes the estimate of the corresponding quantity at that iteration.

Step 2: Given $\hat{f}^i$, the least-square solution to the optimization problem $$\{\hat{e}_k^i\}_{k=1}^N = \arg\min_{e_1,\ldots,e_N} \|\tilde{B}-\tilde{B}\|_2^2, \tag{19}$$

is $$[\hat{e}_1^i, \ldots, \hat{e}_N^i] = (\hat{F}^i(\hat{F}^i)^T)^{-1}\hat{F}^i\tilde{B}_1; \text{where} \tag{20}$$

$$\tilde{B}_1 = [\tilde{b}_1^{tr}, \ldots, \tilde{b}_N^{tr}]; \tag{21}$$

$$\tilde{b}_k^{tr} = [\tilde{b}_k(0), \ldots, \tilde{b}_k(M+C-2)]^T, \tag{22}$$

where the superscript tr stands for truncation of the matrix or vector.

Step 3: Given $\hat{e}_k^i$, the least-square solution to the optimization problem $$\hat{f}^{i+1} = \arg\min_f \|\tilde{B}-\hat{B}\|_2^2, \tag{23}$$

is $$\hat{f}^{i+1} = (\hat{E}^i(\hat{E}^i)^T)^{-1}\hat{E}^i\tilde{B}_2; \tag{24}$$

where the matrix E is defined in Appendix B, and $$\tilde{B}_2 = \begin{bmatrix} \tilde{b}_1^{tr} \\ \vdots \\ \tilde{b}_N^{tr} \end{bmatrix}. \tag{25}$$

Step 4: i=i+1, and repeat Step 2 and Step 3 until i reaches a predetermined value e.g. 100. The initial value might be of importance in the search of good estimates.

In an embodiment, the optimization problem described above is solved using a combination of the iterative least-square search method and the common-acoustical-pole and zero modeling method.

The combination of the ILSS and CPZ methods is referred to as the "ILSSCPZ" method. The ILSSCPZ method uses the estimate from the CPZ model-based approach to provide an initial estimate for the ILSS approach. The invariant model is first extracted by the CPZ model-based approach using a number of poles e.g. 11 poles, and then the impulse response of the extracted AR model is truncated to serve as an initial estimate in the ILSS method.

The components along the feedback path can be divided into three categories:

Category I: Device type dependent components. For a specific device, the effects of the components in this category are invariant or only slowly varying, and are independent of the users and the external acoustical environment. These components include the hearing-aid receiver, microphone, tube attached to the receiver inside the hearing-aid shell, etc.

Category II: User dependent components, which include the PVC tubing, earmold, pinna, etc. The change of the hearing-aid fitting is caused by the change of the components in this category. The change is usually slow but could be fast; for example, when the user moves his/her jaw quickly.

Category III: External acoustical environment dependent components. The change of the components in this category can be very rapid and dramatic, for example, when the user picks up a telephone handset.

The components in Category II and III cause a large inter-subject variability in the feedback path and a large variation of the feedback path over time.

In an embodiment, the feedback path model comprises the invariant feedback path model contained in the fixed filter 104 and representing the invariant components, such as category I components such as the hearing device receiver, microphone, tube attached to the receiver inside the hearing device shell, etc.

Further, the feedback path model may comprise a slowly varying model used to model the slow changes in the components in category I (due to aging and/or drifting), category II components such as user dependent components, which include the PVC tubing, earmold, pinna, etc (due to the slow changes in the hearing-aid fitting) and category III (due to the slow changes in the acoustical environment).

Additionally, the feedback path model may comprise a fast varying model used mainly for modeling the rapid and dramatic changes in the external acoustics, for example, when the user picks up a telephone handset.

The invariant model may be determined as disclosed above and below and it may be contained in the fixed filter 104. The slowly varying model and the fast varying model may be contained in the adaptive filter 105 as two cascaded adaptive filters with different adaptation speeds. A slow adaptation speed in the order of seconds may be used to model the slowly varying components; and a fast adaptation speed in the order of milliseconds may be used to model the fast varying components.

In an embodiment, the abovementioned cascaded adaptive filters are used in parallel, and the hearing device may contain a switch (not shown) controlling which of the two adaptive filters (either the one modeling the slowly varying components or the one modeling the fast varying components) is active in combination with the fixed filter.

In an embodiment, the measured feedback paths are measured on a plurality of users using the same type of hearing device i.e. the same hearing device within manufacturing tolerances. For example, a batch of 10 hearing devices may be tested on a group of 100 individuals (each hearing device being tested on each individual thus resulting in 1000 feedback path measurements in total) and the feedback paths of each of the individuals may be utilized to determine the invariant portion of the feedback path model according to the above and below. Subsequently, the determined invariant portion of the feedback path model may be implemented in a number of subsequent batches of hearing devices e.g. the next 100 batches of hearing devices.

In an embodiment, the hearing device is a digital hearing device such as a digital hearing aid.

Figure 2:
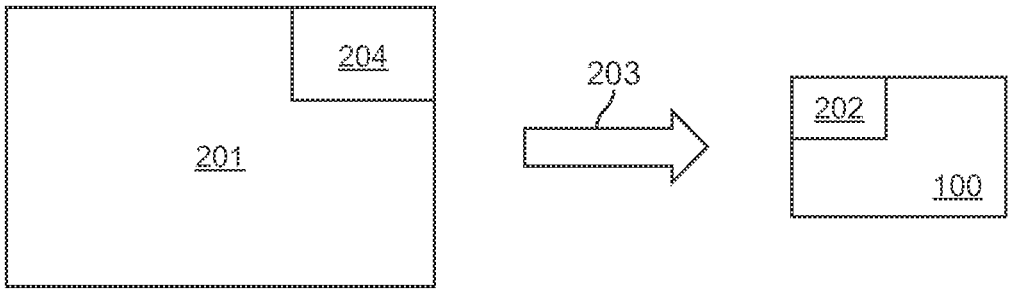
FIG. 2 shows an embodiment of a fitting device.

FIG. 2 shows an embodiment of a device 201 for fitting a hearing device 100 to compensate for the hearing loss of a user.

The hearing device 100 may be a hearing device according to FIG. 1 and it may comprise a receiver and a microphone, and wherein a feedback path exists between the receiver and the microphone. The hearing device 100 may further comprises an adaptive feedback canceller 103 adapted to reduce the feedback; and wherein the adaptive feedback canceller comprises a fixed filter 104 for modeling an invariant portion of the feedback, and an adaptive filter 105 for modeling a variant portion of the feedback. The hearing device 100 and the device for fitting 201 may further comprise respective communication ports 202, 204 such as a Bluetooth transceiver and/or an IR port and/or an IEEE port.

The fitting device 201 may be adapted to be communicatively connected to the hearing device 100 via a wired and/or wireless communication link 203 such as an electrical wire or a Bluetooth link established between the respective communication ports 202, 204 of the device for fitting 201 and the hearing device 100.

Further, the fitting device 201 is adapted to provide the invariant portion of the feedback path model as determined above to the fixed filter 104 of the hearing device 100 via the wired and/or wireless communication link 203. Further, the fitting device 201 may be adapted to provide one or more of the adaptations speeds of the two adaptive filters contained in the adaptive filter 105 of the hearing device 201 via the wired and/or wireless communication link. The adaptive filters can be constrained by initializations carried out during the fitting or during the usage of the hearing device.

Generally, even when the variation within a batch of components, the invariant part is not trivial and the methods and devices described below and above can extract it to such a level that the yielded feedback path model can be used for a plurality of hearing device users.

The factors that limit the modeling accuracy of the feedback path given a fixed order of the variant model are twofold: Firstly, the methods themselves may converge to local minima. To improve these methods, some heuristic methods can be used to prevent the search from being trapped at the local minima easily. A simulated annealing method may in an embodiment be used as such a heuristic method. Secondly, in practice, both the variation within the batch of components and the individual characteristics are part of the variant model, which need a long FIR filter to model.

Figure 3:
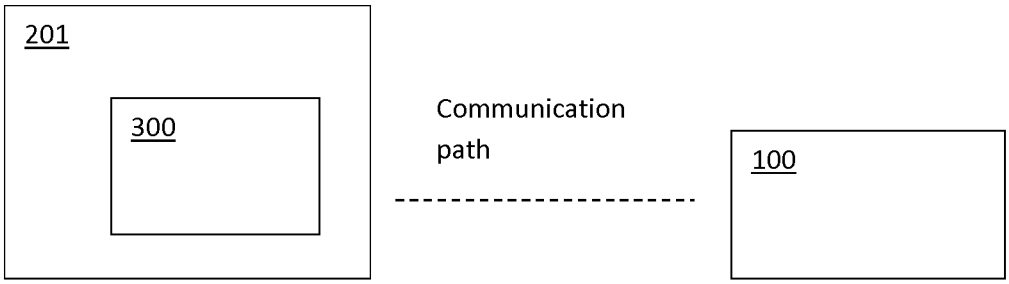
FIG. 3 shows a fitting device with a processor in communication with a hearing device.

In accordance with some embodiments, a fitting device 201 for fitting a hearing device to compensate for a hearing loss of a user is disclosed, the hearing device comprising a receiver and a microphone, wherein a feedback path exists between the receiver and the microphone, wherein the hearing device further comprises an adaptive feedback canceller configured to reduce feedback, the adaptive feedback canceller comprising a fixed filter corresponding to an invariant portion of the feedback path, and an adaptive filter corresponding to a variant portion of the feedback path, the fitting device comprising a processor 300 configured to determine the invariant portion of the feedback path, wherein the processor 300 is configured to provide the fixed filter with information relating to the invariant portion of the feedback path independently of the user using the hearing device (see FIG. 3).

In an embodiment, a processor 300 contained in the fitting device 201 is adapted to calculate the invariant portion as a common part of a plurality of measured feedback paths, wherein the plurality of measured feedback paths are measured on a plurality of users for a type of hearing device substantially identical to the hearing device within production tolerances.

Although particular embodiments have been shown and described, it will be understood that they are not intended to limit the scope of the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

Appendix A

The matrix A used in equation (9) is defined as:

$$A = \begin{bmatrix} A_1 & D & & \\ A_2 & & D & 0 \\ \vdots & & 0 & \ddots \\ A_N & & & D \end{bmatrix};$$

Where $A_k$ is of the size (L+P)×P and defined as:

$$A_k = \begin{bmatrix} 0 & 0 & \dots & 0 \\ \tilde{b}_k(0) & 0 & \dots & 0 \\ \tilde{b}_k(1) & \tilde{b}_k(0) & \dots & 0 \\ \vdots & \vdots & \ddots & \vdots \\ \tilde{b}_k(P-1) & \tilde{b}_k(P-2) & \dots & \tilde{b}_k(0) \\ \vdots & \vdots & \ddots & \vdots \\ \tilde{b}_k(L-1) & \tilde{b}_k(L-2) & \dots & \tilde{b}_k(L-P) \\ 0 & \tilde{b}_k(L-1) & \dots & \tilde{b}_k(L-P+1) \\ \vdots & \vdots & \ddots & \vdots \\ 0 & 0 & \dots & \tilde{b}_k(L-1) \end{bmatrix};$$

and D is of the size (L+P)×(Q+1) and defined as:

$$D = \begin{bmatrix} 1 & & & \\ & 1 & 0 & \\ & 0 & \ddots & \\ & & & 1 \\ 0 & \dots & \dots & 0 \\ \vdots & \ddots & & \vdots \\ \vdots & & \ddots & \vdots \\ 0 & \dots & \dots & 0 \end{bmatrix}.$$

Appendix B

The convolution matrix F is of the size M×(M+C−1) and defined as:

$$F = \begin{bmatrix} 0 & 0 & \dots & f(C-1) \\ 0 & 0 & \dots & 0 \\ \vdots & \vdots & \dots & \vdots \\ 0 & f(0) & \dots & 0 \\ f(0) & f(1) & \dots & 0 \end{bmatrix}.$$

The convolution matrix E is defined as:

$$E = \begin{bmatrix} E_1 \\ E_2 \\ \vdots \\ E_N \end{bmatrix};$$

where the matrix $E_k$ is of the size C×(M+C−1) and defined as:

$$E_1 = \begin{bmatrix} 0 & 0 & \dots & e_k(M-1) \\ 0 & 0 & \dots & 0 \\ \vdots & \vdots & \dots & \vdots \\ 0 & e_k(0) & \dots & 0 \\ e_k(0) & e_k(1) & \dots & 0 \end{bmatrix}.$$

The invention claimed is:

1. A fitting device for fitting a hearing device to compensate for a hearing loss of a user, the hearing device comprising a receiver and a microphone, wherein a feedback path exists between the receiver and the microphone, wherein the hearing device further comprises an adaptive feedback canceller configured to reduce feedback, the adaptive feedback canceller comprising a fixed filter corresponding to an invariant portion of the feedback path, and an adaptive filter corresponding to a variant portion of the feedback path, the fitting device comprising:

a processor configured to determine the invariant portion of the feedback path;

wherein the processor is configured to provide the fixed filter with information relating to the invariant portion of the feedback path independently of the user using the hearing device.

2. The fitting device according to claim 1, wherein the processor is configured to calculate the invariant portion as a common part of a plurality of measured feedback paths, wherein the plurality of measured feedback paths are measured on a plurality of users for a type of hearing device substantially identical to the hearing device within production tolerances.

3. The fitting device according to claim 1, wherein the invariant portion comprises information calculated using a common-acoustical-pole-zero model.

4. The fitting device according to claim 1, wherein the invariant portion comprises information calculated using an iterative least square search.

5. The fitting device according to claim 1, wherein the invariant portion comprises information calculated using a common-acoustical-pole-zero model as an initial estimate for an iterative least square search.

6. The fitting device according to claim 1, wherein the adaptive filter comprises two cascaded adaptive filters with different respective adaptation speeds.

7. The fitting device according to claim 6, wherein the cascaded adaptive filters are configured to operate in parallel, and wherein the hearing device further comprises a switch for controlling which of the two cascaded adaptive filters is active.

8. The fitting device of claim 1, wherein the fitting device is external to the hearing device.

9. A fitting method, comprising:

fitting a hearing device to compensate for a hearing loss of a user, the hearing device comprising a receiver and a microphone, wherein a feedback path exists between the receiver and the microphone, and wherein the hearing device further comprises an adaptive feedback canceller configured to reduce the feedback, the adaptive feedback canceller comprising a fixed filter corresponding to an invariant portion of the feedback path, and an adaptive filter corresponding to a variant portion of the feedback path;

wherein the fitting comprises providing the invariant portion to the fixed filter of the hearing device independently of the user using the hearing device.

10. The method according to claim 9, wherein the fitting comprises calculating the invariant portion as a common part of a plurality of measured feedback paths, wherein the plurality of measured feedback paths are measured on a plurality of users for a type of hearing device substantially identical to the hearing device within production tolerances.

11. The fitting method according to claim 9, wherein the invariant portion comprises information calculated using a common-acoustical-pole-zero model.

12. The fitting method according to claim 9, wherein the invariant portion comprises information calculated using an iterative least square search.

13. The fitting method according to claim 9, wherein the invariant portion comprises information calculated using a common-acoustical-pole-zero model as an initial estimate for an iterative least square search.

14. The fitting method according to claim 9, wherein the adaptive filter comprises two cascaded adaptive filters with different respective adaptation speeds.

15. The fitting method according to claim 14, wherein the cascaded adaptive filters are configured to operate in parallel, and wherein the hearing device further comprises a switch for controlling which of the two cascaded adaptive filters is active.

* * * * *